US005461467A

United States Patent [19]

Malachowski

[11] Patent Number: 5,461,467

[45] Date of Patent: Oct. 24, 1995

[54] CONTROLLED AIR FLOW IN A PREFUSER TRANSPORT

[75] Inventor: Michael A. Malachowski, Webster, N.Y.

[73] Assignee: Xerox Corporation, Stamford, Conn.

[21] Appl. No.: 279,609

[22] Filed: Jul. 25, 1994

[51] Int. Cl.[6] ..... G03G 21/00

[52] U.S. Cl. ..... 355/312; 271/197; 271/276

[58] Field of Search ..... 355/208, 271, 355/273, 282, 312, 315; 219/216; 271/194–197, 276

[56] References Cited

U.S. PATENT DOCUMENTS

| | | | |
|---|---|---|---|
| 3,743,403 | 7/1973 | Sanza | 355/312 |
| 3,774,907 | 11/1973 | Borostyan | 355/312 X |
| 3,794,417 | 2/1974 | Machmer | 355/312 X |
| 4,017,065 | 4/1977 | Poehlein | 355/282 X |
| 4,110,027 | 8/1978 | Sato et al. | 355/312 X |
| 4,286,863 | 9/1981 | Cornwall et al. | 355/312 X |
| 4,417,800 | 11/1983 | Hirose et al. | 355/312 X |
| 4,794,429 | 12/1988 | Acquaviva | 271/197 X |
| 4,905,052 | 2/1990 | Cassano et al. | 355/312 |
| 5,031,002 | 7/1991 | Yaguchi | 355/312 |
| 5,063,415 | 11/1991 | Ariyama | 355/312 |
| 5,166,735 | 11/1992 | Malachowski | 355/282 |
| 5,294,965 | 3/1994 | May | 355/312 |

*Primary Examiner*—Robert Beatty

*Attorney, Agent, or Firm*—J. E. Beck; R. Zibelli; Henry Fleischer

[57] ABSTRACT

An apparatus for advancing a copy sheet includes a moving imaging member having an unfused toner image. The copy sheet is in contact with the moving imaging member to transfer the toner image from the imaging member to the copy sheet. The copy sheet is then engaged by a moving sheet transport. A vacuum draws the copy sheet toward the sheet transport while a pressure sensor detects the vacuum pressure in the transport to control the air flow through the transport so as to maintain a low and constant drive force in response to the level of vacuum sensed by the sensor. The low drive force exerted on the sheet is lower than a holding force of the sheet to the moving imaging member thus causing the sheet to slide on the transport.

17 Claims, 2 Drawing Sheets

CONTROLLED AIR FLOW IN A PREFUSER TRANSPORT

Figure 1:
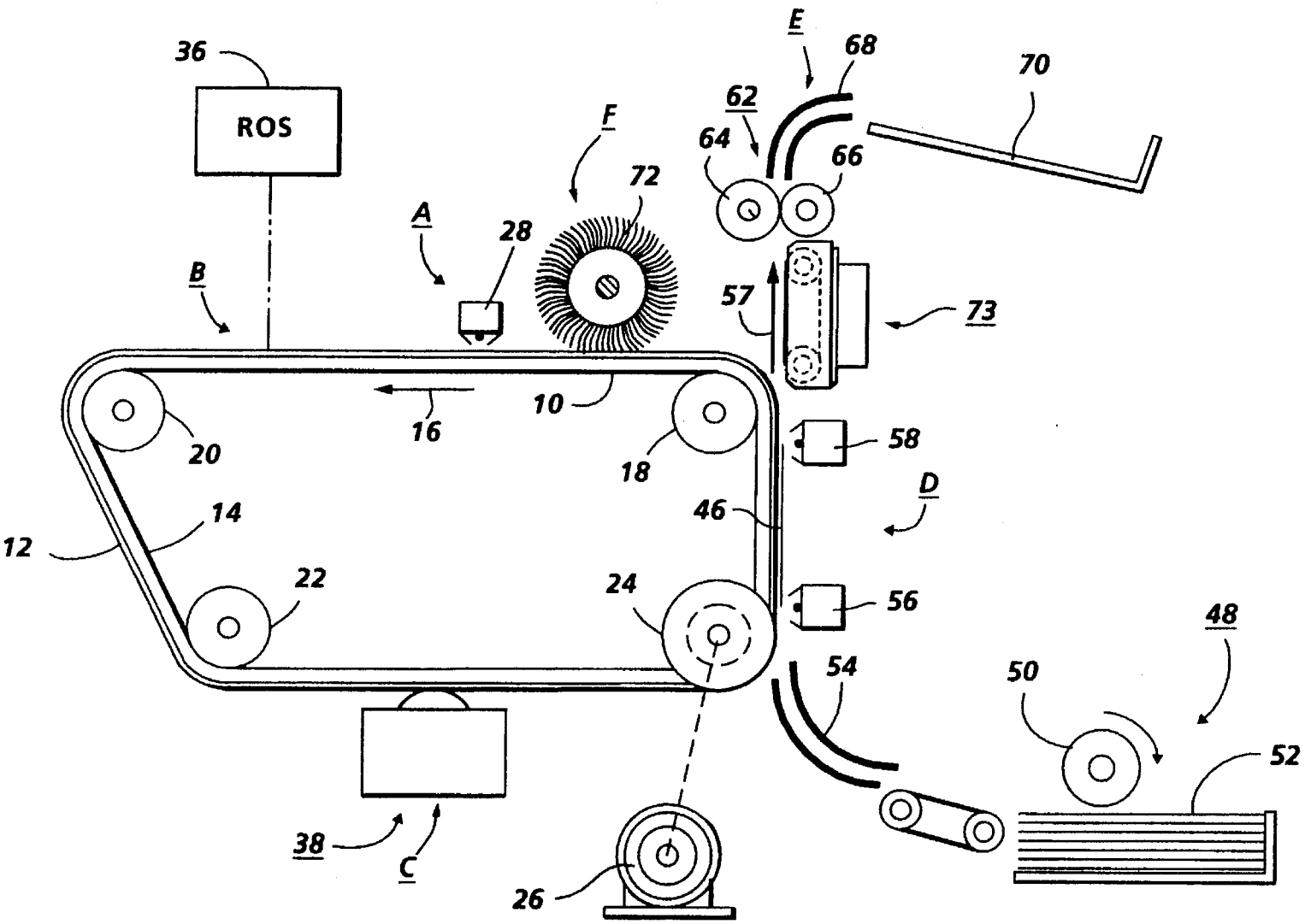

The present invention relates generally to a sheet transport system in an electrophotographic printing machine, and more particularly concerns a sheet transport system which maintains low and constant drive forces necessary to transport copy sheets bearing unfused images.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member.

In the foregoing type of printing machine, the powder image formed on the photoconductive member is transferred from the photoconductive member to a copy sheet. The transferred powder image is typically only loosely applied to the copy sheet whereby, it is easily disturbed by the process of stripping the copy sheet from the photoconductive member and by the process of transporting the copy sheet to a fusing station. The copy sheet preferably passes through a fusing station as soon as possible after transfer to fuse the powder image permanently onto the copy sheet. Fusing prevents smearing and disturbance of the powder image caused by mechanical agitation or electrostatic fields. A particularly desirable fusing station is a roll-type fuser, wherein the copy sheet is passed through a pressure nip existing between two rolls, at least one of which is heated and at least one of which is resilient.

A prefuser transport receives the unfused copy sheet from the photoconductive member and moves it to the fuser rolls. The prefuser transport is driven slightly faster than the photoconductive member to keep the sheet taught between the photoconductive member and the fuser so as to prevent image quality disturbances when the trail edge of the copy sheet leaves the photoconductive member. Belts on the transport move the copy sheet while a vacuum keeps the copy sheet on the transport. When the drive force of the transport becomes greater than the force holding the copy sheet to the photoconductive member, the copy sheet may break free of the photoconductive member and disturb the image being transferred. The motion quality control of the photoconductive member is also disturbed by the reduction in force at the photoconductive member which may occur too quickly for the drive system to overcome it via compensation to regain a constant drive.

Prefuser vacuum transports known in the art of electrophotographic printing use a high, closed port pressure blower strategy. This approach allows sufficient air flow for acquisition, but makes it difficult to control copy sheet drive force, wherein the drive force is a result of an exponentially increasing pressure caused by the copy sheet progressively covering plenum ports. An approach previously taken to overcome this problem uses valving mechanisms, which with gravity loading, respond to the plenum pressure build up and begin to passively open in order to maintain constant pressure and constant drive. Another approach uses a solenoid actuated valve to balance vacuum pressure. Both of these approaches require costly components and be unreliable. Clearly, it would be desirable to have a prefuser transport incorporating a control for balancing static vacuum pressure without the use of expensive mechanical valving techniques.

The following disclosures appear to contain relevant subject matter:

U.S. Pat. No. 4,017,065 Patentee: Poehlein Issued: Apr. 12, 1977

U.S. Pat. No. 5,166,735 Patentee: Malachowski Issued: Nov. 24, 1992

The disclosures of the above-identified patents may be briefly summarized as follows:

U.S. Pat. No. 4,017,065 describes a vacuum transport for moving a copy sheet from an image transfer area to a fuser roll nip. In operation, the transport forms a buckle in the intermediate portion of the copy sheet to compensate for a speed mismatch between the fuser roll nip and the initial image support surface. A manifold having two separate plenum chambers controls the buckle by cyclic reductions in the vacuum applied to the plenum closest to the fuser roll nip. The removal of vacuum from the chamber is accomplished by an electrically operated valve that opens a vent in the manifold top cover to an outside atmosphere.

U.S. Pat. No. 5,166,735 discloses a sheet transport incorporating a control for matching drive speeds imparted to a copy sheet extended between a fuser roll nip and an image transfer area. The transport contains a vacuum plenum which communicates with a receiving surface on the transport. The copy sheet is engaged by the transport and is adhered to the receiving surface by the vacuum. The fuser rolls are driven at a slightly higher speed to tension the copy sheet and lift it from the transport surface. The lifting is detected by a sensor that senses the vacuum in the plenum and accordingly adjusts the drive speed of the fuser rolls.

Pursuant to the features of the present invention, there is provided an apparatus for advancing a sheet from a moving surface exerting a holding force thereon. A transport is included and positioned to receive the sheet leading edge exerting a drive force on the sheet in the same direction as the holding force exerted on the sheet by the surface. A controller is also included and communicates with the transport to regulate the drive force so as maintain the drive force less than the holding force while maintaining the sheet in tension and causing the sheet to slip on the transport until the sheet trailing edge is spaced from the surface.

In accordance with another aspect of the present invention, there is provided a method of advancing a sheet from a moving surface that exerts a holding force thereon, including the steps of: advancing the sheet leading edge from the moving surface onto a transport; moving the transport at a velocity greater than the surface velocity; and controlling the transport to exert a drive force on the sheet less than the holding force to maintain the sheet in tension with the sheet slipping on the transport until the sheet trailing edge is spaced from the surface.

In accordance with yet another aspect of the present invention, there is provided a printing machine of the type in which a sheet receives a developed image from a moving surface exerting a holding force on the sheet to move the sheet therewith, wherein the improvement includes: a transport positioned to receive the sheet leading edge as the sheet leaves the surface, wherein the transport exerts a drive force on the sheet in the same direction as the holding force exerted on the sheet by the surface; and a controller, in communication with the transport, to regulate the drive force so as to maintain the drive force less than the holding force while maintaining the sheet in tension and causing the sheet to slip on the transport until the sheet trailing edge leaves the surface.

Figure 2:
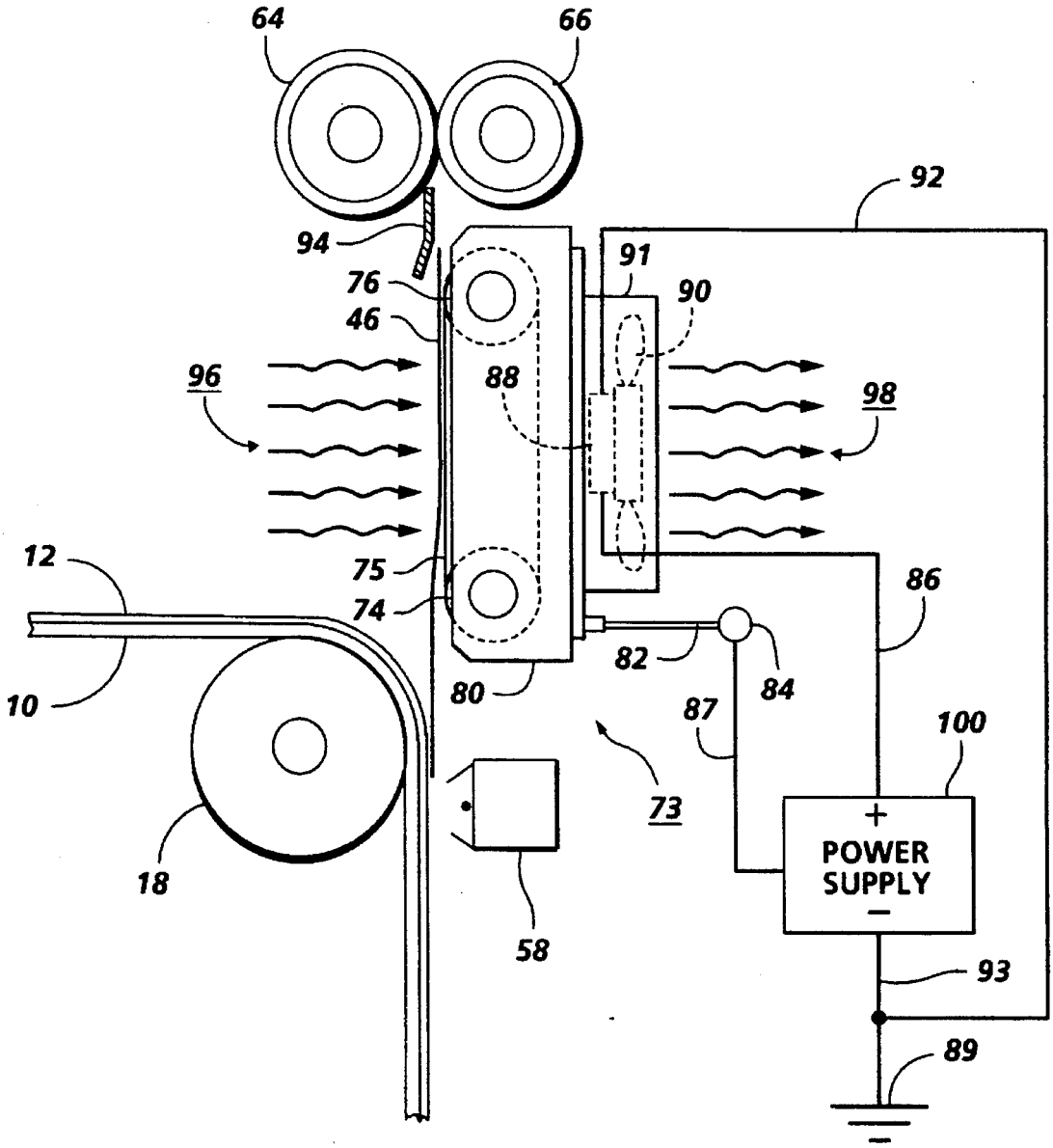

Other aspects of the present invention will become apparent as the following description proceeds and upon reference to the drawings, in which:

FIG. 1 is a schematic, elevational view depicting an illustrative printing machine; and FIG. 2 is a schematic, elevational view of a preferred embodiment used in the FIG. 1 printing machine to control air flow in a prefuser transport in accordance with the present invention.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various elements of an illustrative printing machine incorporating the prefuser transport of the present invention therein. It will become evident from the following discussion that the prefuser transport is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Turning to FIG. 1, the printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. The drive system comprising motor 26 is designed to drive the photoconductive belt 10 at a constant velocity.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used instead of a light lens system. The RIS (not shown), contains document illumination lamps, optics, a mechanical scanning mechanism and photosensing elements such as charged couple device (CCD) arrays. The RIS captures the entire image from the original document and converts it to a series of raster scan lines. These raster scan lines are the output from the RIS and function as the input to a ROS 36 which performs the function of creating the output copy of the image and lays out the image in a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36. ROS 36 is controlled by the output from an electronic subsystem (ESS) which prepares and manages the image data flow between a computer and ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

At development station C, a magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted from the carrier granules to the latent image forming a powder image on the photoconductive surface 12 of belt 10. While dry developer material has been described, one skilled in the art will appreciate that a liquid developer material may be used in lieu thereof.

After development, belt 10 advances the toner powder image to an image transfer station D. At transfer station D, a sheet of support material comprising copy sheet 46 is moved into contact with the toner powder image. Copy sheet 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 50 into sheet chute 54. Chute 54 directs the advancing copy sheet 46 into contact with photoconductive surface 12 of belt 10 in a timed sequence so that the toner powder image developed thereon contacts the advancing copy sheet 46 at image transfer station D.

Image transfer station D includes a corona generating device 56 which applies electrostatic transfer charges to the backside of copy sheet 46 and electrostatically tacks copy sheet 46 against the photoconductive surface 12 of belt 10. The electrostatic transfer charges attracts the toner powder image from photoconductive surface 12 to copy sheet 46. After transfer, the lead edge of copy sheet 46 is transported on the photoconductive surface 12 under a detacking corona generator 58 which neutralizes most of the tacking charge thereon. However, it is not desirable to remove all of the transfer charges on the copy sheet 46, since that may reduce the electrostatic retention of the toner image to copy sheet 46. The detack charge, preferably applied with an alternating current corona emission is sufficient enough to allow copy sheet 46 to self strip from the photoconductive surface of belt 10.

After the lead edge of copy sheet is stripped from the photoconductive surface of belt 10, it travels beneath a prefuser transport 73. The prefuser transport 73 receives the copy sheet 46 with the unfused toner image thereon and advances it to Fusing Station E. The copy sheet 46 moves in the direction of arrow 57. Prefuser transport 73 will be described hereinafter in greater detail, with reference to FIG. 2.

Fusing station E includes a fuser assembly, indicated generally by the reference numeral 62, which permanently affixes the toner powder image to copy sheet 46. Preferably, fuser assembly 62 includes a heated fuser roll 64 and a back-up roll 66. Sheet 46 passes between fuser roller 64 and back-up roll 66 with the toner powder image contacting fuser roll 64. In this manner, the toner powder image is permanently affixed to copy sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

With continued reference to FIG. 1, the drive force applied to copy sheet 46 by prefuser transport 73 is a function of a vacuum pressure, such as, the normal pressure, the contact area of the prefuser transport belt and the copy sheet, and the coefficient of friction of the transport belt. When the drive force by the pretransfer transport 73 on the copy sheet exceeds the tacking force holding the copy sheet 46 to the photoconductive surface 12 of belt 10, copy sheet 46 may break free of the photoconductive surface 12. This may produce smears or skips in the unfused toner image transferred to the trailing edge of the copy sheet. If the copy sheet breaks away from the photoconductive member, it may occur so rapidly that the motion quality of the photoconductive member drive system is disturbed transiently so as to prevent a speed compensated recovery. Thus, the next image being developed on the photoconductive surface 12 may also be disturbed. To prevent copy quality and motion quality degradation, the prefuser transport 73 is driven slightly faster than belt 10. This maintains tension on the copy sheet 46 between the photoconductive surface 12 and the prefuser transport 73. This requires the drive force of the prefuser transport 73 to be less than the belt 10 holding force. The belt 10 holding force is a function of the charging parameters of the transfer corona generator 56 and detack corona generator 57, the tack zone area between corona generators 56 and 58, the velocity of the copy sheet 46, the geometry of the copy sheet path, and the copy quality requirements.

Turning now to FIG. 2, there is shown a schematic elevational view of the prefuser transport 73 used in the FIG. 1 printing machine. The prefuser transport 73 has a sheet receiving surface for receiving copy sheet 46, such as, a foraminous belt 75 entrained over rollers 74 and 76, at least one of which is driven by a motor or driving system (not shown). The foraminous belt 75 is driven at a velocity approximately 0.85% greater than the velocity of belt 10 to maintain tension on sheet 46 between belt 10 and the prefuser transport 73. A plenum 80 communicates with the upper surface of foraminous belt 75 so that copy sheet 46 is drawn against the foraminous belt 75. A conduit 82 extends from the plenum 80 to a pressure sensor 84. Pressure sensor 84 may be a pressure switch or pressure transducer that monitors a vacuum within plenum 80. Although it is shown external to plenum 80, the pressure sensor 84 can be located inside plenum 80. A housing 91, located on the top of plenum 80, contains an air moving device 88 having rotating blades 90 mounted thereon to create a negative air pressure or vacuum beneath the prefuser transport 73 by drawing in air as generally indicated by arrows 96. Air flow 96 sucks the copy sheet 46 against a plurality of vacuum holes (not shown) in the foraminous belt 75. Air is discharged from the exhaust side of the air moving device 88 as indicated by arrows 98. The air moving device 88 is connected to a positive terminal on power supply 100 through a lead 86. The negative terminal of power supply 100 is connected to ground 89 via a lead 93. Likewise, the return side of air moving device 88 is connected to ground 89 through a lead 92 to complete an electrical circuit that energizes the air moving device 88. An electrical signal from the pressure sensor 84 is supplied to power supply 100 through a lead 87 to turn the air moving device 88 on and off. When the vacuum increases in plenum 80, a switch located in pressure transducer 84 is activated. By way of example, the switch may be activated at a selected set point of approximately 0.3 inches of water pressure to deenergize the air mover device 88. At 0.3 inches of water pressure, drive force on the copy sheet 46 by the prefuser transport 73 is approximately 0.3 pounds.

Referring further to FIG. 2, the lead edge of copy sheet 46 passes under the detack corona generator 58 where the transfer charge is neutralized. This enables copy sheet 46 to self strip from the photoconductive surface 12 of belt 10. The lead edge of copy sheet 46 advances to a position adjacent prefuser transport 73. Air is drawn into air ports (not shown) in prefuser transport 73. The air to be drawn through the transport is discharged from the exhaust side of the air moving device 88. A vacuum is created in plenum 80 which sucks copy sheet 46 against prefuser transport 73. Copy sheet 46 is held against and advanced by foraminous belt 75. Belt 75 moves at a slightly faster velocity than the velocity of photoconductive belt 10. This maintains sheet 46 in tension to prevent copy quality disturbances. The air moving device 88 is cycled on and off by pressure sensor 84 to maintain the drive force exerted on sheet 46 less than the holding force of photoconductive belt 10. With the drive force exerted on sheet 46 by belt 75 of transport 73 being lower than the photoconductive belt 10 holding force, copy sheet 46 slips on belt 75 until its trail edge breaks free from the photoconductive belt 10. Copy sheet 46 is moved by transport 73 to guide 94 which guides the leading edge of the sheet into the nip formed by fuser roll 64 and pressure roll 66.

In recapitulation, it is clear that the apparatus of the present invention includes a controlled air flow in the prefuser transport for balancing vacuum pressure to maintain the drive force exerted on the sheet by the prefuser transport less than the holding force exerted thereon by the photoconductive belt.

It is, therefore, evident that there has been provided, in accordance with the present invention, a sheet transport system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations as are within the broad scope and spirit of the appended claims.

I claim:

1. An apparatus for advancing a sheet from a moving surface exerting a holding force thereon, including:

a transport, positioned to receive the sheet leading edge, exerting a drive force on the sheet; and a controller, in communication with said transport, to regulate the drive force so as to maintain the drive force less than the holding force while maintaining the sheet in tension and causing the sheet to slip on said transport until the sheet trailing edge is spaced from the surface.

2. An apparatus according to claim 1, wherein said transport moves at a greater velocity than the surface.

3. An apparatus for advancing a sheet from a moving surface exerting a holding force thereon, including:

a transport, positioned to receive the sheet leading edge, exerting a drive force on the sheet, said transport moving at a greater velocity than the surface and including a moving belt: and a controller, in communication with said transport, to regulate the drive force so as to maintain the drive force less than the holding while maintaining the sheet in tension and causing the sheet to slip on said transport until the sheet trailing edge is spaced from the surface.

4. An apparatus according to claim 3, wherein said transport includes means for holding the sheet against said belt with a selected pressure.

5. An apparatus according to claim 4, wherein said controller includes a sensor for detecting the pressure that said holding means holds the sheet against said belt and de-energizing said holding means in response to the pressure being greater than the selected pressure.

6. An apparatus according to claim 5, wherein said holding means reduces the pressure between the sheet and said belt in response to said sensor indicating that the pressure is greater than the selected pressure.

7. An apparatus according to claim 6, wherein:

said belt defines a plurality of apertures therein; and said holding means includes a blower to draw air through the apertures in said belt to hold the sheet thereagainst.

8. A method of advancing a sheet from a moving surface exerting a holding force thereon, including the steps of:

advancing the sheet leading edge from the moving surface onto a transport;

moving the transport at a velocity greater than the moving surface velocity; and controlling the transport to exert a drive force on the sheet less than the holding force to maintain the sheet in tension with the sheet slipping on the transport until the sheet trailing edge is spaced from the surface.

9. A method according to claim 8, further including the step of pressing the sheet against the transport at a pressure less than a selected pressure.

10. A method according to claim 9, wherein said controlling step includes the step of:

sensing the pressure pressing the sheet against the transport; and reducing the pressure in response to said sensing step indicating that the pressure is greater than the selected pressure.

11. A printing machine of the type in which a sheet receives a developed image from a moving surface exerting a holding force on the sheet to move the sheet therewith, wherein the improvement includes:

a transport, positioned to receive the sheet leading edge as the sheet leaves the surface, said transport exerting a drive force on the sheet; and a controller, in communication with said transport, to regulate the drive force so as to maintain the drive force less than the holding force while maintaining the sheet in tension and causing the sheet to slip on said transport until the sheet trailing edge leaves the surface.

12. A printing machine according to claim 11, wherein said transport moves at a greater velocity than the surface.

13. A printing machine of the type in which a sheet receives a developed image from a moving surface exerting a holding force on the sheet to move the sheet therewith, wherein the improvement includes:

a transport, positioned to receive the sheet leading edge as the sheet leaves the surface, said transport exerting a drive force on the sheet and moving at a greater velocity than the surface, and including a moving belt; and a controller, in communication with said transport, to regulate the drive force so as to maintain the drive force less than the holding force while maintaining the sheet in tension and causing the sheet to slid on said transport until the sheet trailing edge leaves the surface.

14. A printing machine according to claim 13, wherein said transport includes means for holding the sheet against said belt with a selected pressure.

15. A printing machine according to claim 14, wherein said controller includes a sensor for detecting the pressure that said holding means holds the sheet against said belt and de-energizing said holding means in response to the pressure being greater than the selected pressure.

16. A printing machine according to claim 15, wherein said holding means reduces the pressure between the sheet and said belt in response to said sensor indicating that the pressure is greater than the selected pressure.

17. A printing machine according to claim 16, wherein:

said belt defines a plurality of apertures therein; and said holding means includes a blower to draw air through the apertures in said belt to hold the sheet thereagainst.

* * * * *